United States Patent [19]

Auger

[11] 4,012,860

[45] Mar. 22, 1977

[54] ADJUSTABLE RIFLE REST

[76] Inventor: Arnold J. Auger, 636 Zener, Pocatello, Idaho 83201

[22] Filed: May 28, 1975

[21] Appl. No.: 581,689

[52] U.S. Cl. ..... 42/94; 73/167; 89/37 BA

[51] Int. Cl.[2] ..... F41C 29/00

[58] Field of Search ..... 42/94; 89/37 BA, 37 B; 73/167

[56] References Cited

UNITED STATES PATENTS

| | | | |
|---|---|---|---|
| 499,315 | 6/1893 | Borchardt | 42/94 |
| 725,850 | 4/1903 | Konigstein | 42/94 |
| 1,457,407 | 6/1923 | Stokes | 89/37 BA |
| 2,427,365 | 9/1947 | Meister | 89/37 BA |
| 2,599,265 | 6/1952 | Leek | 89/37 BA |
| 3,012,350 | 12/1961 | Wold | 42/94 |
| 3,358,504 | 12/1967 | Freebairn | 89/37 BA |
| 3,827,172 | 8/1974 | Howe | 42/94 |

*Primary Examiner*—Charles T. Jordan
*Attorney, Agent, or Firm*—Clarence A. O'Brien; Harvey B. Jacobson

[57] ABSTRACT

A lower base is provided and an elongated generally horizontal support member is oscillatably supported from the base for angular displacement about a generally horizontal axis. The support member extends in a direction transverse to the axis of oscillation thereof and includes structure spaced above its axis of oscillation for removably stationarily supporting a long gun therefrom with the long gun extending longitudinally of the support member. Adjustment structure is operatively connected between the base and the support member for infinite angular adjustment of the support member relative to the base throughout at least a limited sector of adjustment. In addition, electric motor driven structure is also provided for removable support from a long gun supported from the support member and includes features for operative association with the trigger of the associated long gun, whereby the trigger may be gradually actuated without causing vibration of the long gun.

11 Claims, 6 Drawing Figures

118
28
52
54
60
56
58
64
62
26
32
16
72
48
75
82
78
36
98
20
18
22
26
22
48
56
68
70
72
75
44
46
44
42
132
134
130
128
120
122
124
126

ADJUSTABLE RIFLE REST

BACKGROUND OF THE INVENTION

Various forms of adjustable long gun rests have been heretofore provided to enable long gun sights to be properly adjusted and also to enable close checking of the accuracy of the long gun. However, most long gun rests heretofore designed have proven to be less than 100% efficient in various operational environments with the result that no one form of long gun or rifle rest has been widely accepted for standardization purposes.

Examples of previously patented long gun rests including some of the general structural features utilized in the instant invention are disclosed in U.S. Pat. Nos. 2,427,365, 2,870,683, 3,012,350, 3,041,983 and 3,358,504.

BRIEF DESCRIPTION OF THE INVENTION

The long gun or rifle rest of the instant invention includes various adjustment features thereof of an improved type for not only infinitely adjusting the trajectory angle of the associated handgun but for also enabling adjustment of the base of the rest in accordance to an irregular support surface upon which the rest is disposed. Further, the long gun rest includes additional features whereby slight adjustments in the trajectory angle of the associated long gun may be readily accomplished and the base of the rest is equipped with slightly flexive structure for supporting the base from a suitable support surface in a manner such that recoil forces transferred to the long gun rest from the associated long gun will be substantially completely absorbed by the rest itself and thereby enable repeated firing of the associated long gun with only minimum re-aim of the latter prior to each shot. Still further, the rifle rest includes a trigger actuating accessory to be supported substantially entirely from the associated long gun and which is motor driven and is thereby capable of actuating the associated trigger without any forces being directed upon the associated long gun tending to alter the preset position thereof relative to a target.

The main object of this invention is to provide a long gun rest from which an associated long gun may be repeatedly fired with only minimum re-aiming of the long gun being required after each shot.

Another object of this invention, in accordance with the immediately preceding object, is to provide a rest including an improved adjustment feature thereof whereby the trajectory path of the associated long gun may be infinitely adjusted with little effort.

Another important object of this invention is to provide a rifle rest which does not require the use of sandbag weights or the like.

Another important object of this invention is to provide a rifle rest including a shock absorbing base and provided with adjustment means whereby the attitude of the base relative to an irregular supporting surface therefor may be readily adjusted.

A final object of this invention is to provide a long gun rest in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 1, 2, 2A:
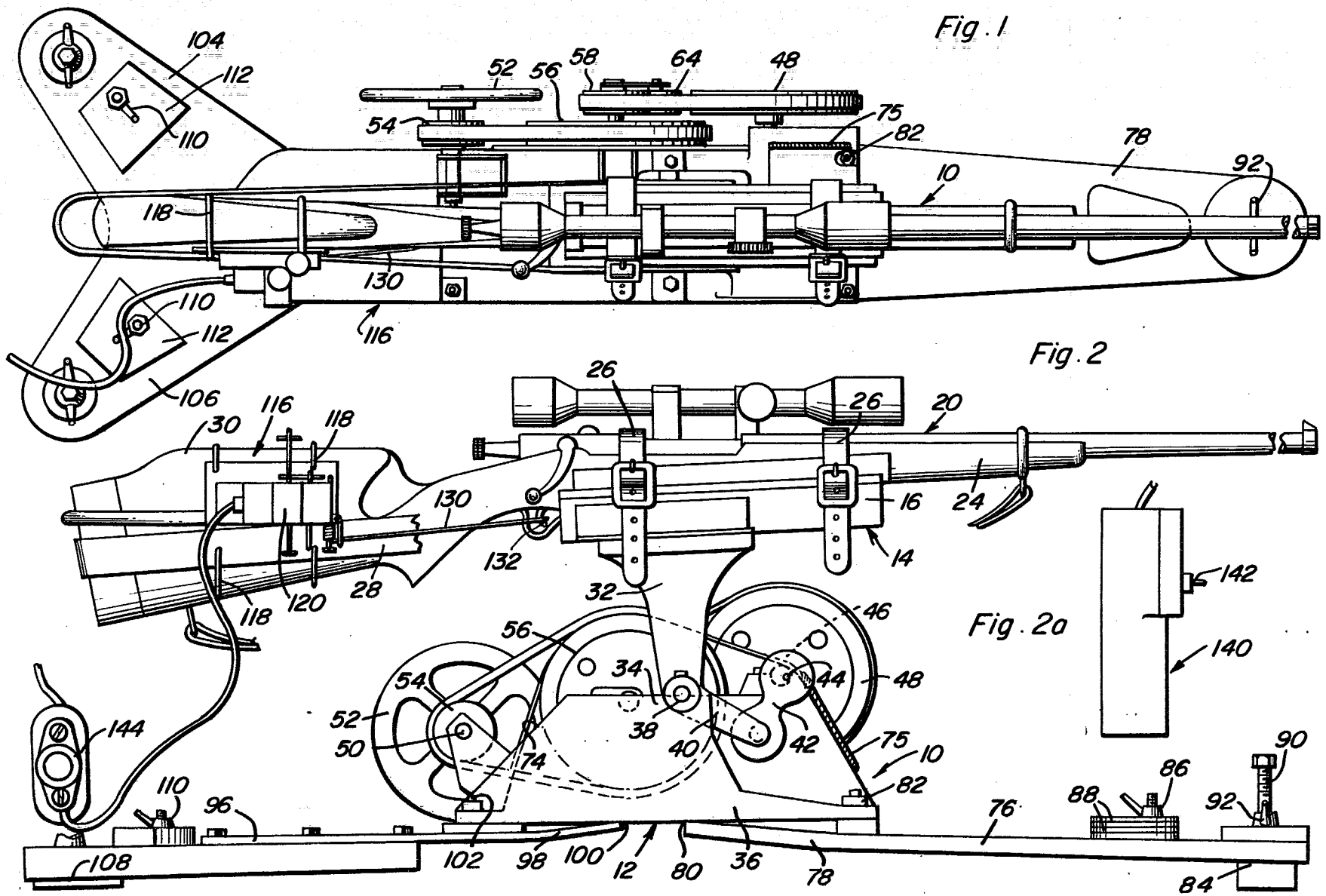
FIG. 1 is a top plan view of the long gun rest having a rifle operatively associated therewith.
FIG. 2 is a side elevational view of the assemblage illustrated in FIG. 1.
FIG. 2*a* is a side elevational view of the battery pack for the electric motor driven trigger actuating accessory.
Figures 3, 4, 5:
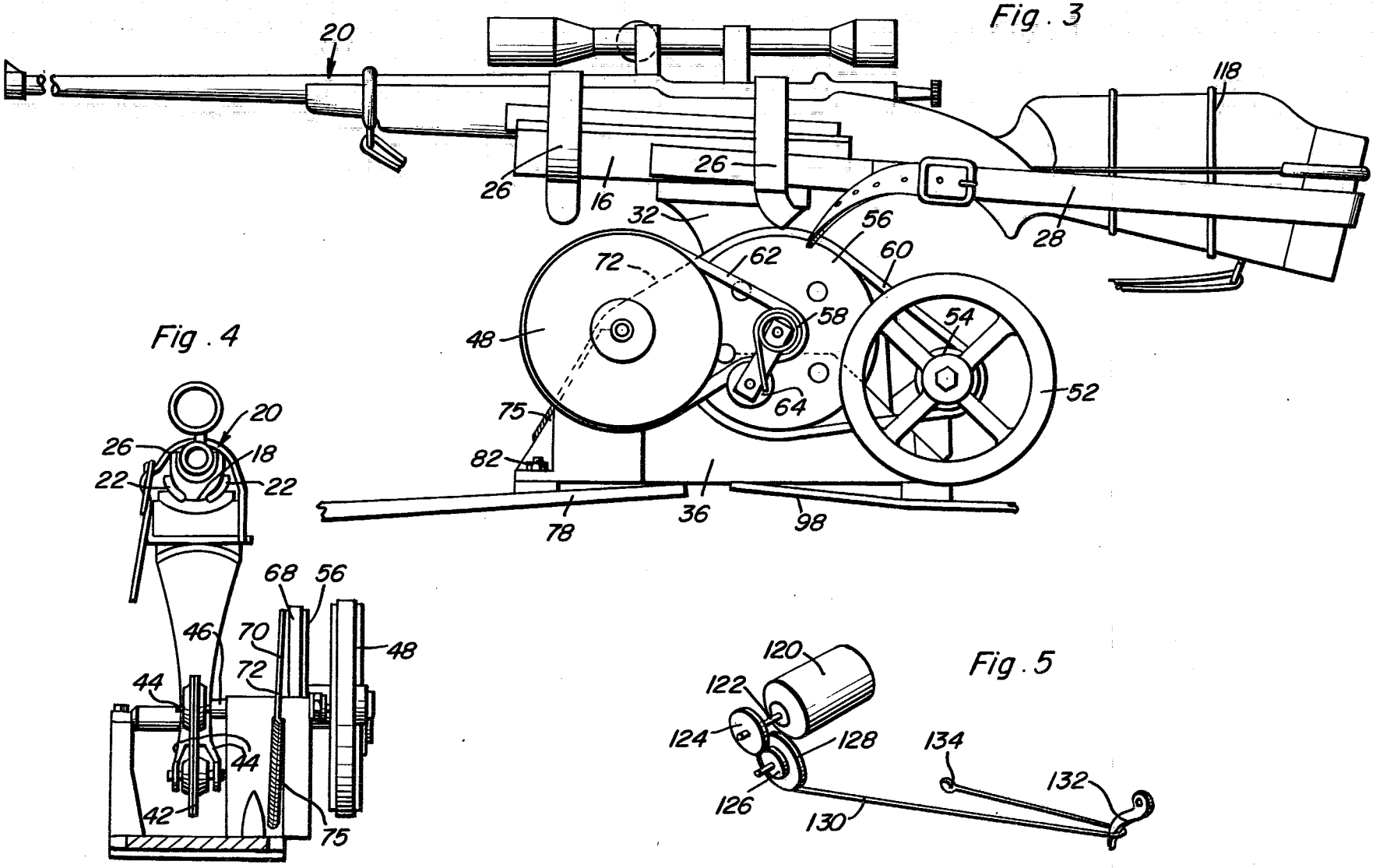
FIG. 3 is a further side elevational view of the assemblage illustrated in FIG. 1 and as seen from the rear side of FIG. 2, portions of the base being broken away.
FIG. 4 is a front elevational view of the assemblage illustrated in FIG. 3 and with portions of the base being omitted.
FIG. 5 is a schematic view of the trigger actuating accessory of the rest.

Referring now more specifically to the drawings, the numeral 10 generally designates the rest of the instant invention. The rest 10 includes a base assembly referred to in general by the reference numeral 12 and a generally horizontal support member referred to in general by the reference numeral 14. The support member 14 includes a horizontally elongated support body 16 defining an upwardly opening longitudinally extending channel 18 in which to cradle a rifle or other long gun such as the rifle referred to in general by the reference numeral 20. The support body 16 includes opposite side resilient cushioning strips 22 for cradling the stock 24 of the rifle 20 and a pair of adjustable length straps 26 are supported from the support body 16 and may be utilized to claim the rifle 20 tightly in the channel 18.

In addition to the straps 26 the support member 14 includes a horizontally and rearwardly projecting forwardly opening strap loop 28 for embracing the butt 30 of the stock 24 and the support member 14 includes a depending support leg 32 pivotally supported from an upper portion 34 of the main body 36 of the base assembly 12 as at 38. The support leg 32 is thus oscillatably supported from the main body 36 for angular displacement about a horizontal axis extending transversely of the support body 16 and spaced above the lower end portion 40 of the support leg 32.

The lower end portion 40 is forwardly directed and bifurcated. One end of a connecting link 42 is oscillatably supported between the furcations 44 of the lower end portion 40 and the other end of the connecting link 42 is journaled on an eccentric pin 44 of a shaft 46 journaled from the main body 36, the end of the shaft 46 remote from the pin 44 having a large diameter flanged wheel 48 mounted thereon for rotation therewith.

The shaft 46 is journaled from a forward upper portion of the main body 36 and a second shaft 50 is journaled from a rear portion of the main body 36 and has a handwheel 52 mounted thereon. The handwheel 52 includes a small diameter flanged pulley 54 supported therefrom and an intermediate large diameter flanged pulley 56 is journaled from an upper portion of the central area of the main body 36. Further, the large diameter flanged pulley wheel 56 includes a small diameter flanged pulley wheel 58 concentric therewith. An endless flexible belt 60 is trained about the flanged pulley 54 and the flanged pulley wheel 56 and a second endless flexible belt 62 is trained about the small diameter flanged pulley wheel 58 and the flanged pulley 48, the belt 62 having a spring-biased tensioning pulley 64 operatively associated therewith whereby the endless flexible belt 62 is maintained in a tensioned state.

The flanged pulley wheel 56 includes a grooved portion 68 extending thereabout with which the mid-portion 70 of an elongated flexible friction braking member 72 is engaged. One end of the member 72 is anchored to the main body 36 in any convenient manner as at 74 and the other end of the member 72 is also anchored to the main body 36 by means of an expansion spring 75 maintaining tension on the member 72 and thus creating a frictional drag against rotation of the flanged wheel 56. Accordingly, it may be seen that the handwheel 52 may be rotated in order to effect angular displacement of the support member 14 and that the angular displacement of the support member 14 will constitute but a small fraction of the corresponding angular displacement of the handwheel 52.

The base assembly includes a forward generally horizontal support arm 76 constructed of substantially rigid but somewhat flexive material. The rear end portion 78 of the arm 76 is slightly upwardly angulated and contacts the undersurface of the main body 36 as at 80. Further, a pair of opposite side fasteners 82 are utilized to secure the support arm 76 to opposite side forward portions of the main body 36 in a manner with the end portion 78 slightly flexed.

The forward end of the arm 76 includes a vertically adjustable foot 84 and a clamp fastener 86 by which a plurality of selected weights 88 may be secured over the forward end of the arm 76. The vertically adjustable foot 84 includes a threaded adjustment screw 90 by which the vertical adjustment of the foot 84 may be accomplished and a jamnut 92 is provided for securing the adjustment screw 90 in adjusted position.

The rear portion of the base 12 further includes a rearwardly projecting support arm 96 corresponding generally to the arm 76 and including an upwardly angulated forward end portion 98 corresponding to the end portion 78, the forward extremity of the end portion 98 contacting the underside of the main body 36 as at 100. Also, a pair of fasteners 102 corresponding to the fasteners 82 are utilized to secure the arm 96 to the rear portion of the main body 36.

The rear end of the arm 96 includes a pair of rearwardly divergent arm segments 104 and 106 each including a dependingly supported and vertically adjustable foot 108 corresponding to the foot 84. In addition, each of the elements 104 and 106 includes a clamp-type fastener 110 corresponding to the fastener 86 by which further weight plates 112 may be secured to the elements 104 and 106.

It is of course to be appreciated that the vertically adjustable feet 84 and 108 are utilized to achieve the desired attitude of the base assembly 12 in relation to an irregular surface upon which the base assembly 12 rests. Then, after a rifle 20 has been secured within the support member 14, the handwheel 52 may be rotated in order to adjustably position the support body 16 and the rifle 20 supported therefrom.

An attachment generally referred to by the reference numeral 116 is provided and includes elastic straps 118 by which the attachment 116 may be secured to the stock 30 in the manner illustrated in FIGS. 1 and 2 of the drawings. The attachment 116 further includes an electric motor 120 having a rotatable output shaft 122 upon which a gear wheel 124 is mounted and the gear wheel 124 is meshed with a second gear wheel 126 having a winding member 128 concentric therewith and to which one end of an elongated flexible pull member 130 is attached for winding thereon. The intermediate portion of the pull member 130 is passed about the trigger 132 of the rifle 20 and the end of the pull member 130 remote from the winding member 128 is suitably anchored as at 134 to the strap loop 28 whereby actuation of the motor 120 will cause the pull member 130 to be wound upon the winding member 28 and the trigger 132 to be actuated.

The electric motor 120 has a battery pack referred to in general by the reference numeral 140 operatively associated therewith and the battery pack 140 is electrically connected to the motor 120 through a first switch 142 carried by the battery pack 140 as well as a second push button-type switch 144. Elongated flexible conductor members extend between the battery pack 140 and the push button switch 144 as well as between the latter and the electric motor 120. The battery pack, switches 142 and 144 and the motor 120 are serially connected. Thus, both switches 142 and 144 must be closed in order to actuate the electric motor 120.

Inasmuch as the arms 76 and 96 are substantially rigid but at least slightly flexive and they are secured to the underside of the main body 36 with the end portions 78 and 98 thereof slightly flexed, any recoil shocks transmitted downwardly from the rifle 20, through the support member 14 and to the base assembly 12 are absorbed by the flexive nature of the arms 76 and 96, thereby enabling the rest 10 to be disposed upon ordinary ground surfaces without the utilization of cumbersome sandbags and yet still enable repeated firing of the rifle 20 with only minimum readjustment of the rest after each shot and prior to the succeeding shot.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A long gun rest comprising an upper elongated generally horizontal support member including first means for removably stationarily supporting a long gun therefrom with said long gun extending longitudinally of said support member, a lower base, second means supporting said support member from said base for oscillation about a generally horizontal axis extending transversely of said support member and spaced below said first means, and third means operatively connected between said base and said support member for infinite angular adjustment of said support member relative to said base about said axis throughout at least a limited sector of adjustment, said third means including rotary actuating means therefor supported from said base and drivingly connected to said support member for angular displacement of the latter through a drive mechanism including a numerically high drive ratio.

2. The combination of claim 1 wherein said base includes front and rear ends underlying opposite ends of said support member, one end of said base including a central vertically adjustable foot and the other end of said base including a pair of opposite side independently vertically adjustable feet.

3. The combination of claim 1 wherein said third means also includes friction generating means operative to frictionally resist angular displacement of said support member relative to said base.

4. The combination of claim 1 wherein said base includes front and rear ends underlying opposite ends of said support member, one end of said base including a central vertically adjustable foot and the other end of said base including a pair of opposite side independently vertically adjustable feet, said base including forwardly and rearwardly projecting generally horizontal front and rear arms supported from and projecting forwardly and rearwardly from the front and rear ends of said base, said arms comprising stiff but slightly flexive members, said adjustable feet being supported from the front and rear end portions of said front and rear arms.

5. A long gun rest comprising an upper elongated generally horizontal support member including first means for removably stationarily supporting a long gun therefrom with said long gun extending longitudinally of said support member, a lower base, second means supporting said support member from said base for oscillation about a generally horizontal axis extending transversely of said support member and spaced below said first means, and third means operatively connected between said base and said support member for infinite angular adjustment of said support member relative to said base about said axis throughout at least a limited sector of adjustment, wherein said base includes front and rear ends underlying opposite ends of said support member, one end of said base including a central vertically adjustable foot and the other end of said base including a pair of opposite side independently vertically adjustable feet, said base including forwardly and rearwardly projecting generally horizontal front and rear arms supported from and projecting forwardly and rearwardly from the front and rear ends of said base, said arms comprising stiff but slightly flexive members, said adjustable feet being supported from the front and rear end portions of said front and rear arms, the front and rear end portions of said front and rear arms including means for removably stationarily supporting selected weight members therefrom.

6. The combination of claim 5 wherein said third means includes rotary actuating means therefor supported from said base and drivingly connected to said support member for angular displacement of the latter through a drive mechanism including a numerically high drive ratio.

7. The combination of claim 6 wherein said third means includes friction generating means operative to frictionally resist angular displacement of said support member relative to said base.

8. A long gun rest comprising an upper elongated generally horizontal support member including first means for removably stationarily supporting a long gun therefrom with said long gun extending longitudinally of said support member, a lower base, second means supporting said support member from said base for oscillation about a generally horizontal axis extending transversely of said support member and spaced below said first means, and third means operatively connected between said base and said support member for infinite angular adjustment of said support member relative to said base about said axis throughout at least a limited sector of adjustment, a long gun trigger actuating mechanism, said mechanism including a rotatable winding member, an elongated flexible tension member having one end thereof anchored to said winding member for winding thereon, an electric motor drivingly connected to said winding member, said tension member including a free end portion adapted to be anchored to said support member and an intermediate portion adapted to be slidingly trained over the forward surface of the trigger of a long gun supported from said support member, said trigger actuating mechanism including means for its support from the butt of a gun supported from said support member, and means for electrically actuating said motor.

9. The combination of claim 8 wherein said means for electrically actuating said motor includes a battery pack and a pair of flexible conductors electrically connecting said pack to said motor, said conductors having a pair of actuating switches serially connected therein.

10. A long gun rest comprising an upper elongated generally horizontal support member including first means for removably stationarily supporting a long gun therefrom with said long gun extending longitudinally of said support member, a lower base, second means supporting said support member from said base for oscillation about a generally horizontal axis extending transversely of said support member and spaced below said first means, and third means operatively connected between said base and said support member for infinite angular adjustment of said support member relative to said base about said axis throughout at least a limited sector of adjustment, said base including front and rear ends underlying opposite ends of said support member, one end of said base including a central depending foot and the other end of said base including a pair of opposite side depending feet, said base including forwardly and rearwardly projecting generally horizontal front and rear arms supported from and projecting forwardly and rearwardly from the front and rear ends of said base, said arms comprising stiff but slightly flexive members, said feet being supported from the front and rear end portions of said front and rear arms, the front and rear end portions of said front and rear arms including means for removably stationarily supporting selected weight members therefrom.

11. A long gun rest comprising an upper elongated generally horizontal support member including first means for removably stationarily supporting a long gun therefrom with said long gun extending longitudinally of said support member, a lower base, second means supporting said support member from said base for adjustable angular displacement about a generally horizontal axis extending transversely of said support member, a long gun trigger actuating mechanism, said mechanism including a rotatable winding member, an elongated flexible tension member having one end thereof anchored to said winding member for winding thereon, said tension member including a free end portion adapted to be anchored to said support member and an intermediate portion adapted to be slidingly trained over the forward surface of the trigger of a long gun supported from said support member, said trigger actuating mechanism including means for its support from the butt of a gun supported from said support member.

* * * * *